US006076489A

United States Patent [19]

Deutsch et al.

[11] Patent Number: 6,076,489

[45] Date of Patent: Jun. 20, 2000

[54] V-TYPE INTERNAL COMBUSTION ENGINE ARRANGEMENT

[75] Inventors: Hermann Deutsch; Frank Metzner, both of Wolfsburg; Frank Meyer-Hessing, Hanover, all of Germany

[73] Assignee: Volkswagen AG, Wolfsburg, Germany

[21] Appl. No.: 09/175,260

[22] Filed: Oct. 20, 1998

Related U.S. Application Data

[63] Continuation of application No. PCT/EP97/02139, Mar. 12, 1997.

[30] Foreign Application Priority Data

Apr. 23, 1996 [DE] Germany ..... 196 16 030

[51] Int. Cl.[7] ..... F02B 75/22

[52] U.S. Cl. ..... 123/54.4; 123/54.8

[58] Field of Search ..... 123/54.4, 54.8, 123/55.1, 54.6, 54.7

[56] References Cited

U.S. PATENT DOCUMENTS 1,705,638 3/1929 Bose ..... 123/55.1
1,772,124 8/1930 Anglu ..... 123/55.1
1,785,175 12/1930 Belden ..... 123/54.4

FOREIGN PATENT DOCUMENTS 1024825 of 0000 France .
490351 of 0000 France .

OTHER PUBLICATIONS

MTZ Motortechnische Zeitschrift; No. 2, Jan. 1, 1940–Dec. 31, 1940, 08–41, pp. 50–53, XP002031828; E. Vohrer: "Grosstriebwerke im Flugmotorenbau".

*Primary Examiner*—Noah P. Kamen
*Assistant Examiner*—Hai Huynh
*Attorney, Agent, or Firm*—Baker Botts L.L.P.

[57] ABSTRACT

For a compact arrangement of a relatively large number of cylinders, the specification discloses a V-type engine having first and second rows of cylinders which are arranged relative to each other so as to form a V-shape, with a third row of cylinders located between the first and second rows and a fourth row located outside the V-space between the first and second rows, the third and fourth rows likewise forming a V-shape between them, and all cylinders of the internal combustion engine being connected to the same crankshaft.

14 Claims, 3 Drawing Sheets

V-TYPE INTERNAL COMBUSTION ENGINE ARRANGEMENT

REFERENCE TO RELATED APPLICATION

This application is a continuation of International Application No. PCT/EP97/02139 filed Mar. 12, 1997.

BACKGROUND OF INVENTION

This invention relates to V-type internal combustion engines having rows of cylinders disposed at an angle to each other.

An internal combustion engine of this kind is disclosed in the German-language periodical *Motortechnische Zeitschrift* (*MTZ*) 52 (1991, No. 3), pages 100ff. The so-called VR engine, which is described there and which is mass-produced by the applicant's assignee, includes cylinders grouped in two rows which are set at a comparatively close acute angle to each other. Compared to conventional V-type internal combusion engines having a relatively wide V-angle, this cylinder arrangement has the advantage that it requires only a single cylinder crankcase, with all cylinders contained in one block, and only one cylinder head common to all of the cylinders. Because the two rows of cylinders are offset from each other in the lengthwise direction of the engine, the over-all length of such a VR engine having, for example, six cylinders is only slightly greater than that of a conventional four-cylinder in-line engine, and it has considerably less width than conventional V-6 internal combustion engines.

The cylinder banks of the VR engine are at an angle of 15° with respect to each other, and the three cylinder center-lines of each row of cylinders lied in a common plane, intersecting that of the other row at a spacing of 12.5 mm below the crankshaft. This compact drive results in a further shortening of the engine.

For the geometry of the VR engine crank drive and the crank-shaft crank positions for that engine, as well as the ignition sequences, reference is made to *Motortechnische Zeitschrift* (*MTZ*) 51 (1990, No. 10), which describes this VR-engine concept in detail and includes proposals regarding the use of one, two or three camshafts in the common cylinder head to actuate two or four valves each per combustion chamber.

To achieve a maximally compact cylinder arrangement, beside the VR engine already cited, a number of further engine arrangements have been proposed.

Thus, the German-language book *Luftgekühlte Fahrzeugmotoren* [Air-cooled vehicle engines], Mackerle-Jehlicka-Moebus-Frank-sche Verlagsbuchhandlung, Stuttgart, page 509, discloses a 16-cylinder engine with an H-shaped cylinder disposition. A compact arrangement is achieved by positioning two 8-cylinder Boxer internal combustion engine one above the other. Each of these engines has its own crankshaft, and the two crankshafts are coupled together to drive a single output shaft. The opposed 4-cylinder rows in each engine are not displaced with respect to each other in the longitudinal direction since the two connecting rods of mutually opposed cylinders have a forked connection on a common crank of the crankshaft.

The same publication, at pages 515ff., discloses another compact engine arrangement in the shape of an X. In this engine, two rows of cylinders are disposed in a V-arrangement which is symmetrical with respect to a vertical plane and all of the cylinders act on a straight crank drive with a common crankshaft. Thus, all of the cylinder axes intersect the central longitudinal axis of the crankshaft. The crankshaft has only four cranks since each crank is acted upon by a main connecting rod and three auxiliary connecting rods. Consequently, the four rows of cylinder have no longitudinal offset with respect to each other.

Another compact arrangement of a plurality of cylinders in an internal combustion engine which is in the shape of a W is disclosed in the German-language periodical *sportauto,* March 1988, No. 3, pages 90ff. This comparatively wide but short cylinder arrangement has three 4-cylinder rows, a central row being in a vertical plane, and the other two rows being arranged in a V configuration with the first row bisecting the V-angle. These three rows are offset longitudinally with respect to each other, since each crank of the crankshaft has the connecting rods of three cylinders connected to it in side-by-side relation.

One problem with this arrangement is in supplying intake combustion air to the combustion chambers associated with the cylinders uniformly and in removing the exhaust gases since there are inlet passages for only two rows of cylinders in the V-space on one side of the horizontal plane whereas the other side of that V-space must accommodate both the inlet passages associated with one of the rows of cylinders and the outlet passages of the other row of cylinders.

Lastly, *Motortechnische Zeitschrift* 1940, No. 2, pages 52 and 53, discloses a combination of two V-type internal combustion engines to make a double-V engine with the cylinders arranged so that the bisectors of the angles of the two V-rows, which each have a cylinder angle of 60°, make a 90° angle with each other. In this case each of the cylinders is connected to a separate crankshaft.

SUMMARY OF THE INVENTION

Accordingly, it is an object of the present invention to provide a V-type internal combustion engine arrangement having rows of cylinders disposed at an angle to each other which overcomes disadvantages of the prior art.

Another object of the invention is to provide a V-type internal combustion engine arrangement having rows of cylinders set at an angle to each other and offset lengthwise from each other so that, while as little space is occupied as possible, a compact arrangement of a relatively large number of cylinders is made possible and, at the same time, the supply of intake air and elimination of exhaust gases is unimpeded and satisfactory driving of the intake and exhaust valves is assured.

These and other objects of the invention are attained by providing a V-type internal combustion engine arrangement having two additional rows of cylinders which are also disposed in V-shaped relation to each other, one of the additional rows of cylinders being positioned in the V-space between the first and second rows and the other, fourth row of cylinders being located outside of the V-space, and the cylinders of all rows being connected to a common crankshaft. With a suitable choice of the angles between the several rows of cylinders, it is possible to provide a compact cylinder arrangement, in particular maintaining a short dimension in the direction of the crankshaft centerline. The even number of the rows of cylinders likewise provides a symmetrical arrangement of ducts for air intake and for exhaust gases.

This arrangement also provides the basis for a series of similar internal combustion engines having different numbers of cylinders, while preserving the fundamentally compact arrangement and retaining existing intake and exhaust lines. Either even numbers or odd numbers of cylinders may be provided in each row.

In a preferred embodiment, to achieve a comparatively simple structure, the additional, third and fourth rows of cylinders are offset lengthwise form each other and from the first two rows of cylinders. Thus, while avoiding the necessity for dual forked connecting rods of comparatively complicated and costly manufacture, uniform single connecting rods may be provided for all of the cylinders.

Preferably, the V-angle between the first and second rows of cylinders and the V-angle between the third and fourth rows of cylinders are identical and the V-spaces formed by these angles are angularly spaced by a selected angle. This displacement angle is chosen so that the first and the third, or the second and the fourth, cylinder rows are symmetrical with respect to the other two cylinder rows about a median plane of the engine extending through the crankshaft. Assuming a vertical median plane, the result is that there are two rows of cylinders on each side of the median plane, the rows on each side also being in V-shaped relation to each other with a comparatively small angle between those rows.

In further preferred embodiment of the invention, the crank drive of the internal combustion engine is straight, that is, the cylinder centerlines of the two rows on one side of the median plane intersect along a line below a plane perpendicular to the median plane and extending through the crankshaft and on the opposite side of the median plane from the cylinders. This permits a further shortening of the engine by interdigitation of the cylinders associated with each pair of rows.

To achieve uniform ignition intervals, with, for example, two cylinders in each row, making a total of eight cylinders, a star crank with four throws may be provided by the crankshaft pattern, each crank having two connecting rod bearings longitudinally offset from each other. Each offset crank is connected through corresponding connecting rods to the pistons in two cylinders which are angularly displaced from each other by the angle between the first and third cylinder rows or the second and fourth cylinder rows.

Alternatively, for example, to obtain an internal combustion engine having a total of 10 cylinders, two of the rows of cylinders may comprise three cylinders each, and the other two rows may have two cylinders each.

Preference is given to the use, insofar as possible, of like parts, and to achieving a symmetrical arrangement, by arranging the cylinder rows having the larger number of cylinders offset from each other by the basic V-angle.

In a further preferred embodiment, the two rows of cylinders located on one side of the median plane and offset from each other by the small angle are each combined into an integral cylinder block, which may be covered by a cylinder head common to those two rows.

For optimal occupation of space by the control drive of the engine, for example, the two integrated rows of cylinders on either side of the median plane may have identical overall configurations, whereby additional advantageous effects may be achieved in terms of parts outlay, assembly etc.

BRIEF DESCRIPTION OF THE DRAWINGS

Further objects and advantages of the invention will be apparent form a reading of the following description in conjunction with the accompanying drawings, in which.

DESCRIPTION OF PREFERRED EMBODIMENTS

Figure 1:
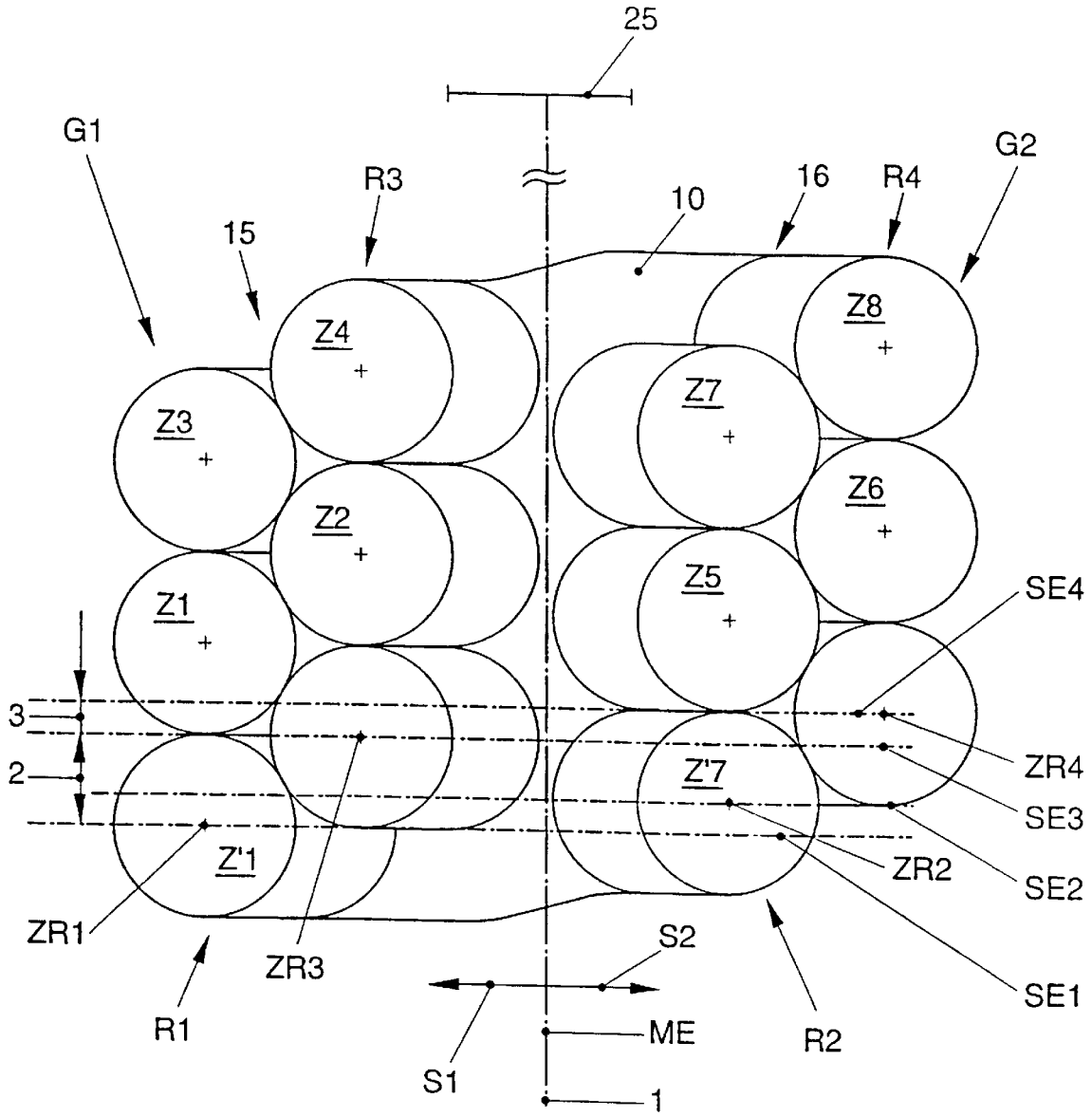
FIG. 1 is a schematic top view showing a representative embodiment of an internal combustion engine according to the invention.

In the typical embodiment of the invention shown in the drawings, a reciprocating internal combustion engine, hereinafter referred to simply as the engine, comprises four rows, of cylinders, R1, R2, R3 and R4, one pair of these rows, R1 and R3 or R2 and R4, being arranged on each side S1 and S2 of a median plane ME containing a crankshaft center-line 1.

The row R1 on the side S1 and the row R2 on the side S2 are arranged in a V with respect to each other at an angle $\delta 1$ referred to herein as a fork angle, thus defining a first V-space V1 between them.

Similarly, the other two rows R3 and R4 associated with sides S1 and S2, respectively, are disposed at a fork angle $\delta 2$ defining another V-space V2. In the embodiment shown in the drawings, the third row R3 is in the first V-space V1, while the fourth row R4 is outside of the space V1.

The cylinder rows R1 and R3 located on the side S1 of the median line ME are combined to make a cylinder group G1 and the cylinder centerlines ZR1 of the first row and ZR3 of the third rod form a V-shaped cylinder angle $\alpha G1$. In the illustrated embodiment, the fork angles S1 and S2 are identical as are the angles $\alpha G1$ between the first and third rows R1 and R3 and $\alpha G2$ between the second and fourth rows R2 and R4, which are referred to herein as the cylinder angles. These angles are arranged with respect to the median plane ME so that the groups G1 and G2 have mirror-image symmetry with respect to the median plane, and so that the pairs of cylinder rows R1 and R3 and R2 and R4 in these groups G1 and G2, respectively, are arranged in mirror-image symmetry with respect to the plane ME.

The cooperation of the cylinders in the crank drive will be described herein in terms of an 8-cylinder embodiment of the engine. As shown in FIG. 1, the cylinders Z1 and Z3 are in the first row R1, the cylinders Z2 and Z4 are in the third row R3, the cylinders Z5 and Z7 are in the second row R2, and the cylinders Z6 and Z8 are in the fourth row R4.

Figure 2:
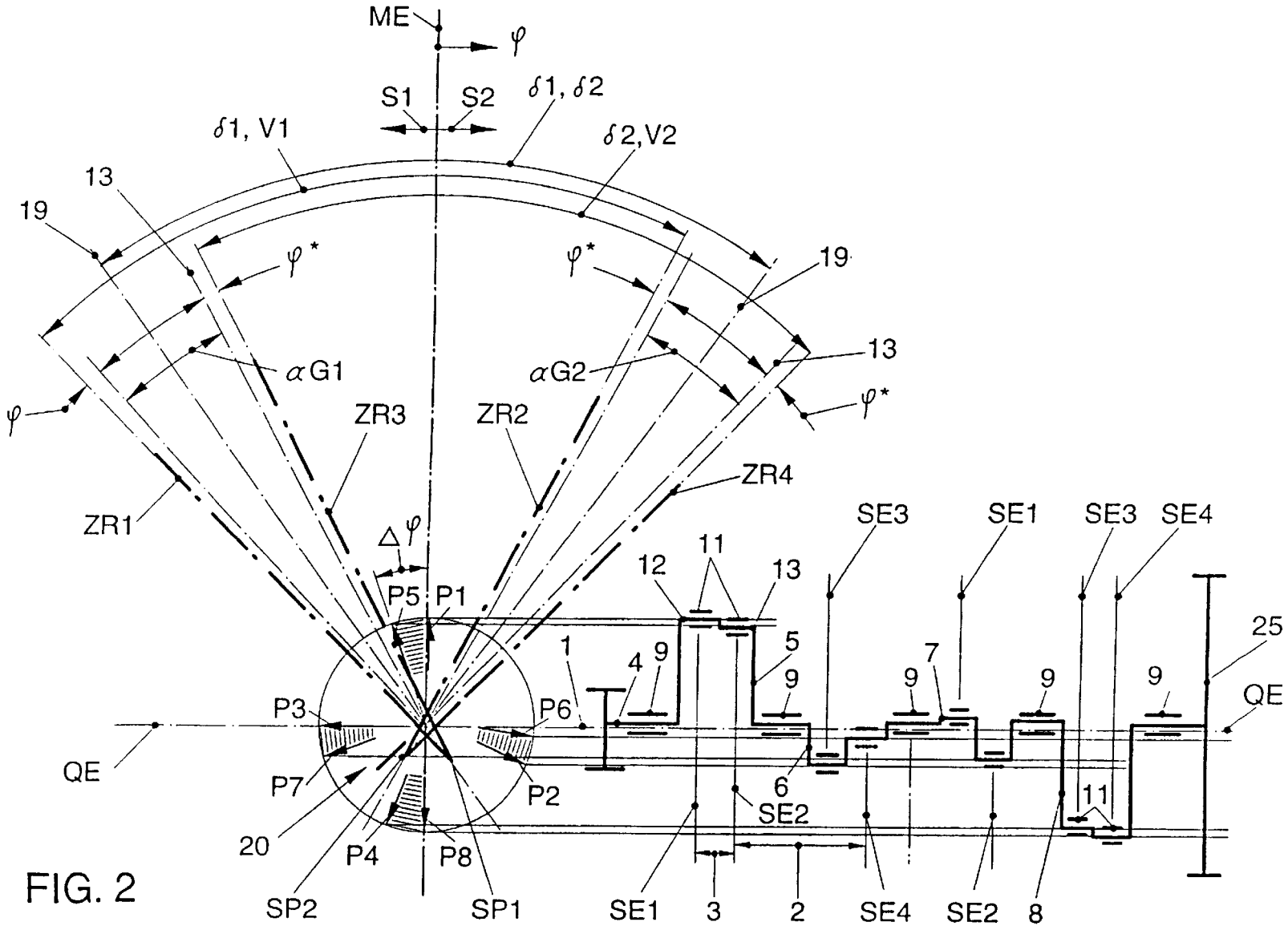
FIG. 2 is a schematic side view of the crank drive in the arrangement shown in FIG. 1.

A crankshaft 4 in the engine has four cranks 5, 6, 7 and 8 and is mounted on a total of five main bearings 9 in a crankcase 10. For the sake of a uniform and convenient ignition sequence, pairs of cylinders act through their associated connecting rods 11 on each of the franks, the two connecting rod bearings 12 and 13 of a crank being angularly offset by an angular difference $\Delta\Phi$ as shown in FIG. 2. The pairs of cylinders acting on each crank and associated with one of the V-spaces V1 and V2 are spaced by the group offset 3 and drive one of the cranks. Thus the connecting rods 11 connect the cylinders Z1 and Z5 to the crank 5, the cylinders Z2 and Z6 to the crank 6, the cylinders Z3 and Z7 to the crank 7 and the cylinders Z4 and Z8 to the crank 8. As seen in FIG. 2, the connecting rods 11 of the cylinders Z1 and Z5, lying in the sectional planes SE1 and SE2, are spaced from each other in the crank 5 by the group offset 3. The connecting rods 11 of the cylinders Z5 and Z6 in the sectional planes SE2 and SE4 are spaced by the row offset 2, commonly refereed to as the cylinder spacing.

The crank drive of the engine is skewed, that is, the cylinder centerlines, ZR1 and ZR3, and ZR2 and ZR4, which are at the cylinder angles $\alpha G1$ and $\alpha G2$ to each other, do not intersect at the crankshaft centerline 1. Instead, a point of intersection SP1 of the first group G1 lies below a transverse plane QE intersecting the median plane perpendicularly along the crankshaft centerline 1, i.e., the side of the transverse plane QE away from the rows R1 and R3, and on the side S2. There is another point of intersection SP2 of the second group G2 located in mirror-image fashion with respect to the median plane ME.

Because of the skewed crank drive, the maximum extensions of the connecting rods 11 at the top and bottom dead centers OT and UT do not coincide with the corresponding cylinder centerline ZR. Considering the crank angle $\phi$ generated by rotation of the crank of an unskewed crank drive, from a line 13 parallel to the cylinder centerline ZR through the crankshaft centerline 1, then for a skewed crankshaft OT and UT are reached at a crank angle offset of $\phi^*$ shown in FIG. 2. Because of the location of the points of intersection SP1 and SP2 on the side opposite from the groups G1 and G2 with respect to the transverse plane QE, there is a positive or negative skew such that the bottom dead center UT follows the top dead center OT after either more than or less than 180° of crank angle.

Figure 3:
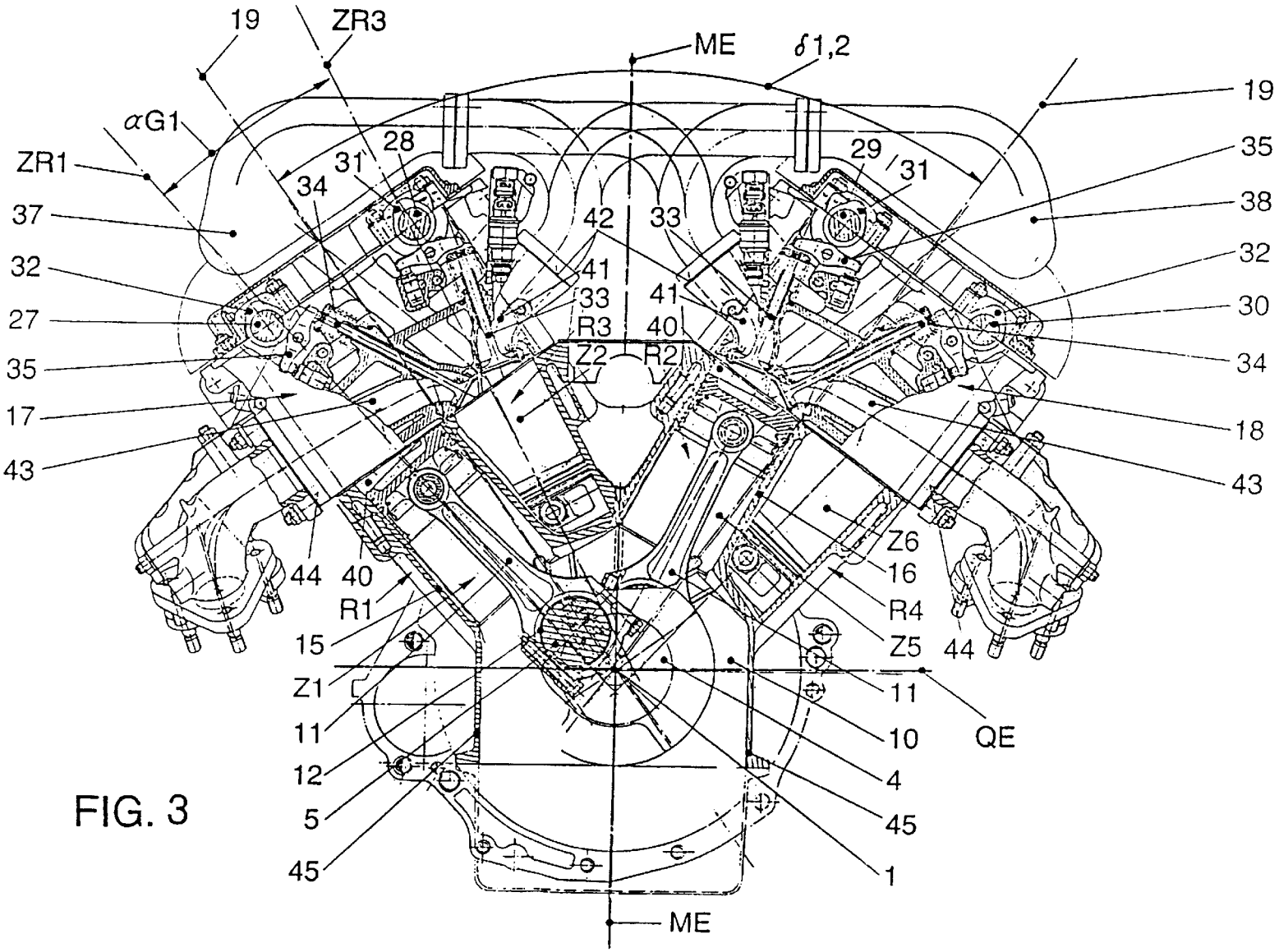
FIG. 3 is a cross-sectional view of an internal combustion engine arrangement according to the invention.

The selected skew enables the cylinders to be packed in a space-optimizing manner within the groups G1 and G2, so that the several cylinders of these groups G1 and G2 can be cast together in common cylinder block portions 15 and 16, respectively. These are each covered with a cylinder head 17 or 18 shown in FIG. 3 which is common to the two rows of cylinders of a group.

The arrangement of the 8-cylinder engine explained above may be briefly illustrated by a numerical example. In a typical embodiment, the fork angles $\delta 1$ and $\delta 2$ are 72° and the cylinder angles $\alpha G1$ and $\alpha G2$ are each 15°. Because of the symmetrical arrangement with respect to the median plane ME, the fork angle $\delta 1$ or $\delta 2$, applies also to the bisectors 19 of the cylinder angles $\alpha G1$ and $\alpha G2$. Because the four cranks 5–8 are in two planes, an ignition sequence establishes itself between the several cylinders at an interval of a 90° crank angle $\phi$. Given a selected ignition sequence in the order Z1-Z5-Z4-Z8-Z6-Z3-Z7-Z2, the ignition time locations, indicated by the arrows P1 to P8 associated with the cylinders Z1 to Z8, are established in the crank star diagram 20 at the left of FIG. 2. Whereas between the cylinders Z1 and Z5, which act of a common crank 5, an angle of 90° would yield a harmonious ignition interval, the fork angle $\delta$ of 72° establishes an angular difference $\Delta\phi$ of 18°, where in this case upon ignition of the cylinder Z1 at top dead center OT, the cylinder Z5 in the sequence, as a result of the selected fork angle $\delta$, the cylinder angle $\alpha G$ and the angular crank offset $\phi^*$, a crank angle of about 140° results. At the firing time of the cylinder Z4, the cylinder Z8 operating on the same crank 8 again lags by the angular difference $\Delta\phi$ of 18°.

Alternatively, in a 10-cylinder arrangement the angular offset of the connections to each of the individual cranks 5–8 may be dispensed with. In this arrangement three cylinders are assigned to each of the rows R3 and R4, while the rows R1 and R2 have two cylinders each. Whereas the mirror-image arrangement of the angular locations with respect to the median plane ME as previously described is preserved in this case, the arrangement of the rows is not mirror-image, since the three-cylinder row R3 located on the side S1 is next followed on the side S2 by a two-cylinder row R2.

On the assumption that this again is a four-stroke engine, at a fork angle of 72° the offset within the total of five cranks may be dispensed with. To achieve a uniform ignition interval of 72° crank angle $\phi$, the five cranks lie in five planes all told.

In another arraignment having a total of 12 cylinders, a fork angle of 72° in a four-stroke engine establishes an ignition sequence with a crank angle $\phi$ interval of 60°. Here the crankshaft 4 has a total of six cranks offset by the angular difference $\Delta\phi$. Assuming the same fork angle $\delta$ of 72° and an ignition interval of 60°, the resulting angular difference $\Delta\phi$ at each crank is 12°. In this case, referring to FIG. 1, a cylinder Z'1 of the first row R1 acts together with the seventh cylinder Z'7 of the row R2 on one crank, in which case, after ignition of Z'1 at OT, the cylinder Z'7 pulls ahead by the angular difference $\Delta\phi$ of 12°.

The crankshaft 4 has a flywheel 25 on the driven side. Adjacent to this, a chain drive is arranged to drive the camshafts 27 and 28 of group G1 and camshafts 29 and 30 of group G2 shown in FIG. 3. Acting through cams 31 and 32, these crankshafts actuate inlet valves 33 and outlet valves 34 which are in the form of tappet valves with interposed rocker levers 35, each cylinder Z1 to Z8 having four tappet valves.

The symmetrical and four-row arrangement of the cylinders permits the configuration of fully symmetrical passages of like conformation for fresh air intake ducts as well as a symmetrical arrangement of exhaust ducts.

An air intake system for each combustion chamber 40 of the engine is substantially symmetrical with respect to the median plane ME and is provided with manifold regions 37 and 38 located above the groups G1 and G2. Combustion air is passed by way of intake ducts 41 from the manifolds 37 and 38 to the combustion chamber intake passages, all inlet passages 41 of a group G1 or G2 opening into one flange 42 located on the row R3 or the row R2 toward the median plane ME. All exhaust passages 43 of the given group G1 or G2 pass to flanges 44 of the rows R1 and R3, which are outboard with respect to the median plane ME.

The cylinder blocks 15 and 16 are made in one piece and are integrated with the crankcase 10, whose outerwalls 45 intersect the transverse plane QE near the crankshaft centerline 1.

Although the invention has been described herein with reference to specific embodiments, many modifications and variations therein will readily occur to those skilled in the art. Accordingly, all such variations and modifications are intended within the included scope of the invention.

We claim:

1. A reciprocating internal combustion engine arrangement comprising;

a first row of cylinders and a second row of cylinders oriented in a V-shaped relation to each other at a first fork angle to provide a first V-space, the cylinders in one of the rows being offset from the cylinders of the other row in the longitudinal direction of the engine;

a third row of cylinders and a fourth row of cylinders oriented in V-shaped relation to each other at a second fork angle to provide a second V-space, one of the third and fourth rows of cylinders being positioned in the V-spaced between the first and second rows of cylinders and the other of the third and fourth rows of cylinders being positioned outside of the V-space between the first and second rows of cylinders; and a common crankshaft to which pistons in all of the cylinders are connected and having a central axis disposed in a median plane extending through the V-space;

wherein the cylinder centerlines of the first and second rows of cylinder are disposed in sectional planes which are perpendicular to the median plane and are uniformly spaced from each other along the crankshaft axis by a first spacing and wherein the cylinder centerlines of the second and fourth rows of cylinders are disposed in sectional planes which are perpendicular to the median plane and uniformly spaced form each other by a second spacing and wherein a sectional plane containing the cylinder centerlines of all of the cylinders in the second row passes between sectional planes containing the cylinder centerlines of all of the cylinders in the first row and in the third row of cylinders, respectively.

2. A reciprocating internal combustion engine arrangement according to claim 1 in which the second spacing is greater than the first spacing.

3. A reciprocating internal combustion engine arrangement according to claim 2 wherein the first and second fork angles have identical size and wherein the first and second V-spaces are angularly displaced from each other by a cylinder angle and are oriented with respect to the median plane so that the first and third rows of cylinders and the second and fourth rows of cylinders are in mirror-image symmetry with respect to the median plane.

4. A reciprocating internal combustion engine arrangement according to claim 3 wherein the cylinder centerlines of the cylinders in the first and third rows of cylinders and of the cylinders in the second and fourth rows of cylinders, respectively, intersect at points which are located on the opposite side of a transverse plane extending perpendicular to the median plane and through the crankshaft centerline with respect to the location of the corresponding cylinder rows and on the opposite side of the median plane from the location of the corresponding cylinder rows.

5. A reciprocating internal combustion engine arrangement according to claim 3 wherein the total number of cylinders in all of the rows of cylinders is an integral multiple of the number of rows of cylinders and wherein pairs of cylinders in the first and second rows or in the third and fourth rows which are offset from each other by a fork angle are connected to a common offset crank of the crankshaft.

6. A reciprocating internal combustion engine according to claim 5 wherein the cylinder centerlines which are longitudinally spaced form each other by the first spacing have pistons connected to a common crank of the crankshaft.

7. A reciprocating internal combustion engine according to the claim 5 wherein the cylinder centerlines which are spaced from each other by the second spacing have pistons connected to separate cranks of the crankshaft.

8. A reciprocating internal combustion engine arrangement according to claim 3 wherein two of the rows of cylinders contain an identical number of cylinders which is a number greater than the number of cylinders in each of the other two rows.

9. A reciprocating internal combustion engine arrangement according to claim 8 wherein the rows of cylinders having the greater number of cylinders are offset from each other by the fork angle.

10. A reciprocating internal combustion engine according to claim 1 wherein a cylinder angle formed between the first row of cylinders and the third row of cylinders or between the second row of cylinders and the fourth row of cylinders is small enough that the cylinders of the first and third rows are integrated in a first group in a one-piece cylinder block and the cylinders of the second row are integrated in a second group in a one-piece cylinder block.

11. A reciprocating internal combustion engine arrangement according to claim 1 wherein the first and second fork angles are between 60° and 90°.

12. A reciprocating internal combustion engine arrangement according to claim 11 wherein the first and second fork angle are 72°.

13. A reciprocating internal combustion engine arrangement according to claim 11 wherein a first cylinder angle between the cylinders of the first row of cylinders and the cylinders of the third row of cylinders and a second cylinder angle between the cylinders of the second row of cylinders and the cylinders of the fourth row of cylinders are both between 10° and 20°.

14. A reciprocating internal combustion engine arrangement according to claim 13 wherein the first and second cylinder angles are 15°.

* * * * *